United States Patent [19]

Roberts

[11] Patent Number: 5,014,628

[45] Date of Patent: May 14, 1991

[54] LATCH MECHANISM

[76] Inventor: Kent S. Roberts, 550 S. 100 W., American Fork, Utah 84003

[21] Appl. No.: 451,620

[22] Filed: Dec. 18, 1989

[51] Int. Cl.[5] ..... A47B 3/00

[52] U.S. Cl. ..... 108/133; 292/302

[58] Field of Search ..... 108/131, 133; 292/273, 292/277, 302, 341.15

[56] References Cited

U.S. PATENT DOCUMENTS

| | | | |
|---|---|---|---|
| 827,673 | 7/1906 | Swart | 108/133 |
| 1,576,455 | 3/1926 | Parker | 108/131 |
| 2,672,387 | 3/1954 | Barricks | 108/133 |
| 2,712,486 | 7/1955 | Kleinsorge | 108/133 |
| 3,918,752 | 11/1975 | Leone et al. | 292/302 |
| 4,219,231 | 8/1980 | Igel | 292/277 |

*Primary Examiner*—Kenneth J. Dorner
*Assistant Examiner*—Gerald A. Anderson
*Attorney, Agent, or Firm*—Mallinckrodt & Mallinckrodt

[57] ABSTRACT

The invention comprises a latch mechanism, particularly adapted for a table with folding legs, having a latch bar, a latch-bar-receiving member incorporating notches for receiving the latch bar, a latch-bar-securing member, and a compression spring for urging the latch-bar-securing member into the latched position. The latch-bar-securing member incorporates an inclined plane configuration which serves as a wedge to hold the latch bar firmly secured in place regardless of wear or loose fit of the component parts.

20 Claims, 2 Drawing Sheets

LATCH MECHANISM

BACKGROUND OF THE INVENTION

1. Field

The invention is in the field of latch mechanisms and has particular but not exclusive application to the latching into place of the legs of a folding table.

2. State of the Art

There are numerous types of latch mechanisms that have been developed for use in latching gates, doors, folding table legs, and a variety of other devices. Normally, such latch mechanisms comprise a latch member, such as a bar or strip, a receiving member for receiving the latch member, means for positioning the latch member in the receiving member, and means for releasing the latch member from its latched position. For some mechanisms, gravity is relied upon to position the latch member in the receiving member, and in other mechanisms a spring is provided. For some mechanisms, an electrically operated solenoid is provided as the means for releasing the latch member, and in other mechanisms a manually operated pull chain or wire is provided. Normally, such latch mechanisms are fashioned such that the latch member fits loosely in the receiving member so as to facilitate latching or unlatching, and also so as to avoid the necessity for close-tolerance component parts.

SUMMARY OF THE INVENTION

According to the invention, the latch mechanism comprises a latch bar, a latch-bar-receiving member having a pair of aligned notches for receiving the latch bar in a latched position, a latch-bar-securing member for firmly securing the latch bar in the aligned notches of the latch-bar-receiving member, and a compression spring for uring the latch-bar-securing member into the latched position. The latch-bar-securing member incorporates an inclined plane configuration which serves as wedge means to hold the latch bar firmly in the aligned notches in the latch-bar-receiving member, thus assuring firm and tight latching regardless of wear of the component parts, or of loose fitting due to manufacturing tolerances.

The latch-bar-receiving member is preferably in the form of an elongate housing, substantially tub-shaped, which contains the latch-bar-securing member. The latch-bar-securing member is preferably a second elongate, tub-shaped piece which fits closely but loosely in the elongate housing and which in turn contains a compression spring arranged so that one of its ends bears against an internal wall in the latch-bar-securing member and so that the other end protrudes through a bore in the rearward end wall of the latch-bar-securing member and bears against the rearward end wall of the elongate housing, thus urging the latch-bar-securing member forwardly in the elongate housing. The forward end of the latch-bar-securing member incorporates the inclined plane configuration which is adapted to ride forwardly over the latch bar, as urged by the spring, when the latch bar is positioned in the notches in the elongate housing, thus holding the latch bar firmly in place.

The elongate housing is open at the top, thus providing a passageway for insertion of the latch-bar-securing member therein, and preferably is provided with flanges for attaching to a mounting surface. The forward end of the elongate housing is also open for allowing insertion of the latch bar. The aligned notches are positioned near this forward end and are formed in the side walls of the elongate housing in a vertical orientation with an opening sufficient to allow insertion of the latch bar.

Latching is effected by forcing the latch-bar-securing member rearwardly against the action of the compression spring, preferably by means of the latch bar itself, to the point where the latch bar drops into the aligned notches. At this point, the latch-bar-securing member is urged forwardly by the compression spring with the inclined plane portion riding over the latch bar and wedging it tightly in place.

Unlatching is effected by manually pushing the latch-bar-securing member backwards against the action of the compression spring and removing the latch bar from the aligned notches. A protuberance is provided on the latch-bar-securing member, which projects through a slot in the underside of the elongate housing, thus providing means for manually effecting the unlatching.

The latch mechanism is particularly adapted for a folding table leg mechanism wherein a latch mechanism is utilized at each end of a table cooperating with a pair of folding table legs. The latch bar is fashioned in the shape of a U wherein the loop portion of the U engages the notches in the latch mechanism and the long straight sides of the U are pivotally attached to the pair of legs which in turn are pivotally attached to the underside of the table top. Unfolding of the legs and latching is accomplished by simply tipping the table and pulling upwards on a pair of legs. Conversely, unlatching and folding of the legs is accomplished by simply pushing on the protuberance and urging the table legs downwardly.

THE DRAWINGS

The best mode presently contemplated for carrying out the invention is illustrated in the accompanying drawings in which:

FIG. 1 is a perspective view of a table with a latch mechanism and a pair of table legs attached to each end of the table, with one pair of legs folded and another pair of legs unfolded;

FIG. 2, a perspective view of the latch-bar-receiving housing member;

FIG. 3, a perspective view of the latch-bar-securing member;

FIG. 4, a top plan view of the latch-bar-receiving housing member, showing the latch-bar-securing member contained therein and a fragmentary portion of the latch bar;

FIG. 5, a bottom plan view looking at the bottom side of the latch-bar-receiving housing member; and FIG. 6, a vertical section taken along the line 6—6 of FIG. 4 with portions in the background omitted.

DETAILED DESCRIPTION OF THE ILLUSTRATED EMBODIMENT

Figure 1:
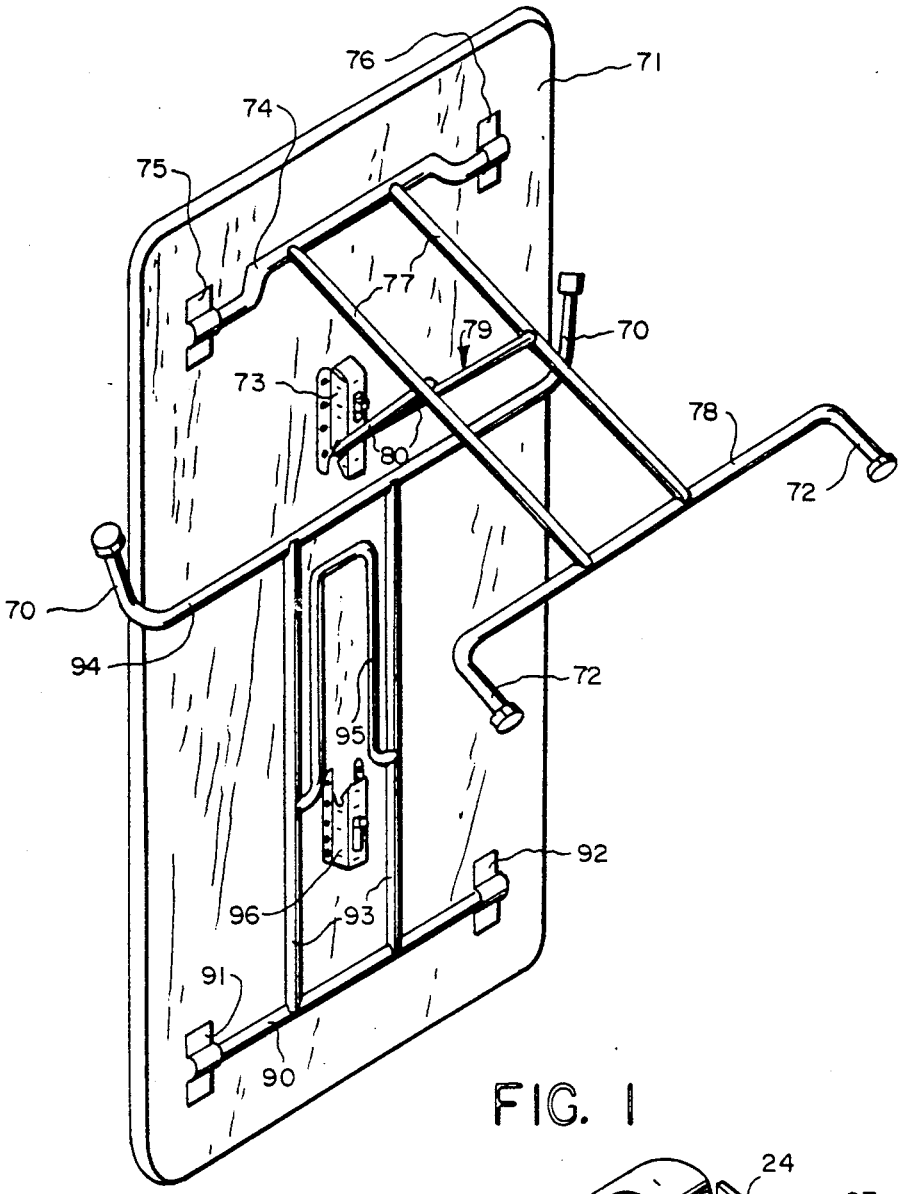

A preferred form of the latch mechanism of the invention is shown in FIG. 1 as applied to a typical folding table whose legs fold against the underside of the table top and are held in place by means of latch mechanisms of the invention.

In the form shown, the latch mechanism comprises a latch bar 10, a latch-bar-receiving member 11 for receiving the latch bar 10, a latch-bar-securing member 12, and a compression spring 13.

Figure 2:
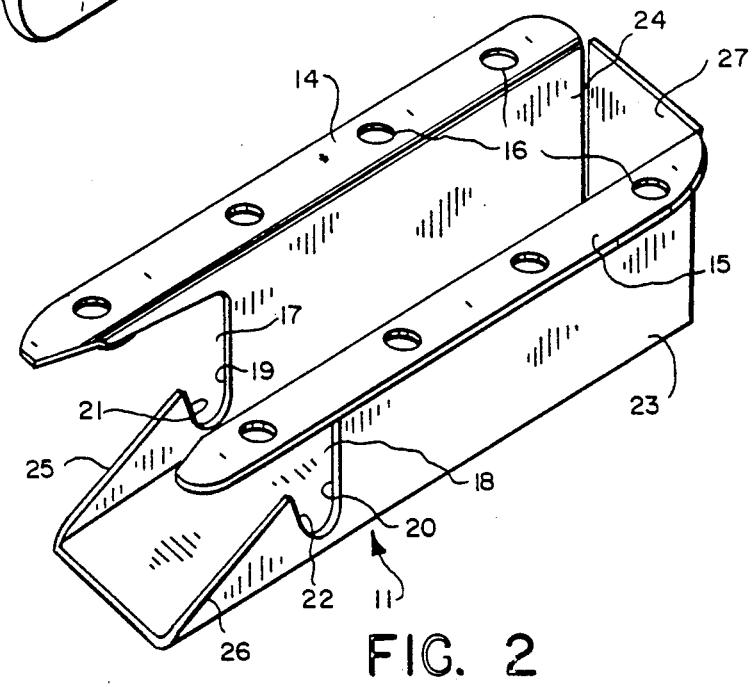
Figure 4:
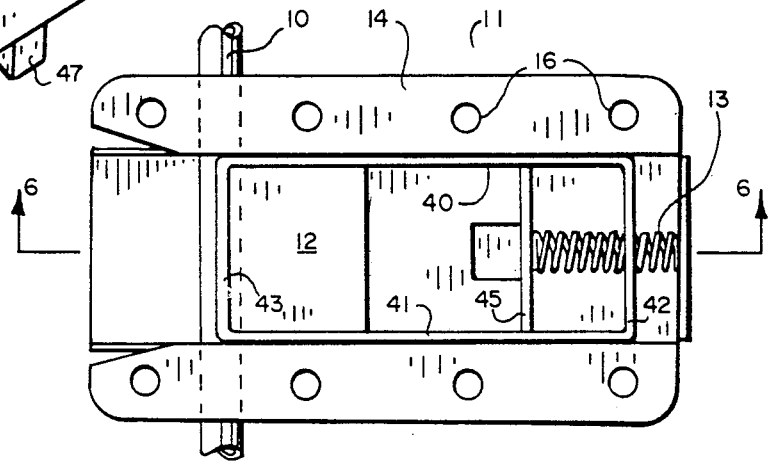

As shown best in FIG. 2, the latch-bar-receiving member 11 is an elongate sheet metal housing open at the top and at one end and sized so as to contain the latch-bar-securing member 12 as shown in FIG. 4. Two flanges 14 and 15 are fashioned at the top, with eight screw holes, such as 16, passing therethrough. This arrangement permits the housing to be attached to a mounting surface, such as a table top or gate, by means of screws.

Latch-bar-receiving member 11 also has two side-by-side aligned notches 17 and 18 formed in respective sides and near the forward end thereof, as shown in FIG. 2. These notches are open along an upper forward edge of the housing and are so sized as to receive latch bar 10. Additionally, the rearward edge of each notch, see 19 and 20, is substantially vertical, whereas the forward edge, see 21 and 22, slopes at an angle of approximately 10 degrees with respect to the vertical. This slope results in a significant advantage of this invention when compared to other latch mechanisms in that it facilitates the unlatching operation, as will be explained further on.

Additionally, the rearward edge is rounded at the bottom, the result being that the forward edge and the rearward edge converge as they approach the bottom. They are dimensionally configured such that latch bar 10 fits tightly between said edges prior to reaching the bottom of said notches. This contributes significantly to stability of a table with folding legs utilizing such latch mechanisms, as will be explained further on. This feature also permits the accommodation of different sized latch bars.

In addition, each side panel, 23 and 24, of housing 11, has its forward edge, 25 and 26, configured so as to form a ramp, sloping upwardly and rearwardly from its bottom forward point, and intersecting a corresponding notch, 17 or 18, such that there is sufficient opening to permit insertion of the latch bar 10. This ramp configuration facilitates latching as will be explained further on.

Figure 5:
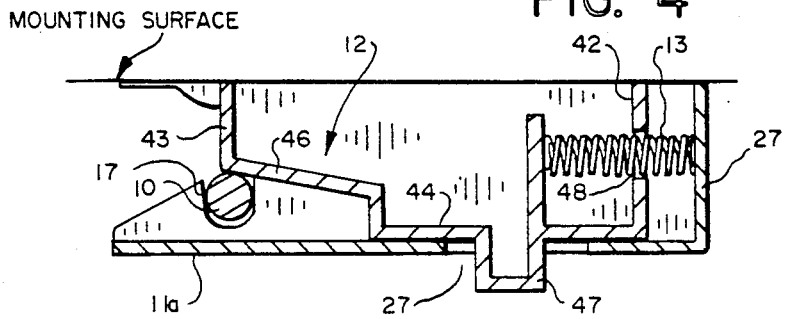
Figure 6:
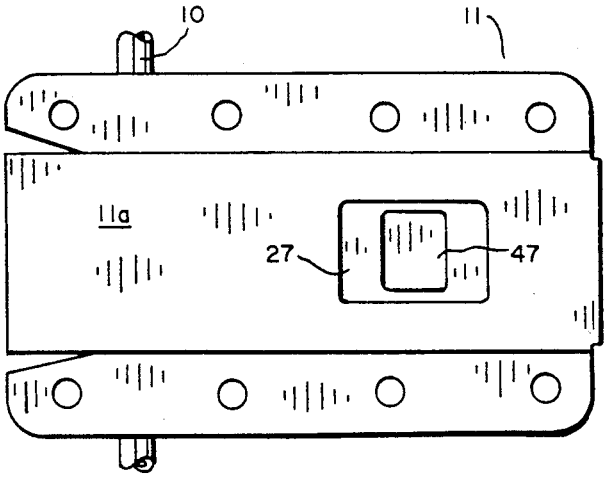

A notch 27 is also formed in the bottom wall 11*a* of housing 11 as shown in FIGS. 5 and 6.

Figure 3:
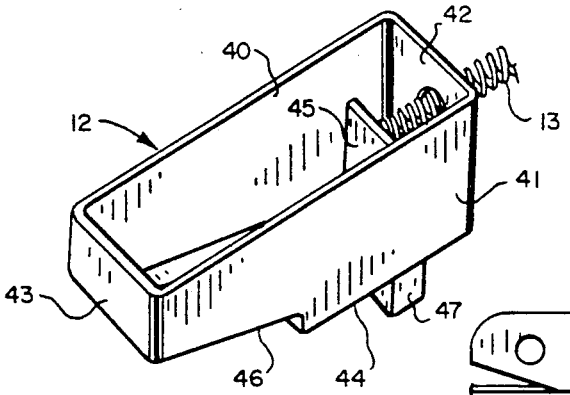

Latch-bar-securing member 12, as shown in FIGS. 3, 4, and 6, is a molded elongate plastic piece, generally tub shaped, and molded from any suitable plastic. It has side walls 40 and 41, rearward end wall 42, forward end wall 43, and irregularly shaped bottom 44. In addition, it has an inner wall 45, parallel to end wall 42 but spaced apart therefrom. The forward portion of the bottom has an upward slope 46 which serves as the inclined plane noted previously and providing a wedge formation so configured as to allow it to slide forwardly over latch bar 10, as shown best in FIG. 6, thus continually pressing and wedging the latch bar firmly in place in notches 17 and 18 under the urging of spring 13 and unlimited by other structure.

Latch-bar-securing member 12 also has a protuberance 47 extending downwardly and projecting through notch 27 in latch-bar-receiving housing 11. This protuberance provides means for manual rearward motion of latch-bar-securing member 12 in order to effect unlatching.

Latch-bar-securing member 12 also has a bore 48 passing through end wall 42 for receiving compression spring 13, as shown in FIGS. 3, 4, and 6.

Compression spring 13 is sized so as to fit in a compressed position between end wall 27 of housing 11 and inner wall 45 of latch-bar-securing member 12, being most fully compressed when protuberance 47 is slid rearwardly in notch 27 and least compressed, but still compressed, when protuberance 47 is slid forwardly as far as possible in notch 27.

The latch mechanism then operates as follows: Latch bar 10 is urged manually in a rearward direction, thus riding up the aforementioned ramp formed by edges 25 and 26, pressing against end wall 43 of latch-bar-securing member 12, and forcing it rearwardly against spring 13 until latch bar 10 falls into notchs 17 and 18. At this point, latch-bar-securing member 12 is urged forwardly by spring 13 with inclined plane 46 riding up and over latch bar 10, thus securing it firmly in place. The wedge action assures a tight fit, automatically compensating for wear of any component parts or variations due to manufacturing tolerances. It is important to note that the downwardly converging edges of slots 17 and 18, coupled with the fact that the width of the slots at their bottom extremity is less than the diameter of the latch bar, contributes to this tightness of fit. This is an important feature of this invention, particularly when the latch mechanism is utilized with folding table legs as in FIG. 1, since it inhibits unwanted wobble of the table.

The forwardly and upwardly sloping forward edges of notches 17 and 18, at an angle of approximately 10 degrees, also assist in the unlatching operation. In order to unlatch the latch mechanism, it is only necessary to retract latch-bar-securing member 12 by manually pushing protuberance 47, rearwardly and by urging the latch bar forwardly. The sloping forward edges of notches 17 and 18 allow the latch bar to ride up and out of the slots, thus making it unnecessary to manually lift the latch bar out of the slots.

The utilization of inner wall 45 in latch-bar-securing member 12 as, spaced apart from end wall 42 to serve as the bearing means for compression spring 13, also represents a significant advantage over other latch mechanisms. This feature allows the utilization of a spring which is longer axially, and therefor has a longer effective working stroke, than would be the case if the spring were to bear against end wall 42. Alternatively, if it were not for this feature, it would be necessary to increase the space between end wall 42 of latch-bar-securing member 12 and end wall 27 of housing 11, thus increasing the size and cost of the latch mechanism. In addition, the feature of the spring being positioned in bore 48 of end wall 42 serves to prevent spring 13 from becoming askew during repetitive operations, another significant advantage.

In the folding table of FIG. 1, one application of the latch to a folding table leg mechanism is shown. One pair of legs 70 is shown in a folded-flat position against the underside of table top 71. A second pair of legs 72 is shown in an unfolded position and latched in place by means of latch mechanism 73 which in turn is fastened to the underside of the table top.

A first elongate pivoting member 74 is pivotally attached near one end of the table top by means of brackets 75 and 76. A pair of elongate table leg members 77 have one end attached, respectively, to an intermediate portion of member 74, as shown, and the opposite end attached to an intermediate portion of a second elongate member 78, which in turn has its opposite ends curved outwardly at an angle of approximately 90 degrees so as to form the pair of table legs 72.

In addition, first elongate member 74 has its intermediate portion, to which table leg members 77 are attached, offset so that the longitudinal axis of its intermediate portion is spaced away from the longitudinal axis of its end portions sufficiently far as to allow table leg members 77, transverse member 78, and legs 72 to fold substantially flat, but on top of legs 70 and their supporting members when they are in their folded position.

The loop portion of a resilient U-shaped member 79, having a circular cross section, serves as the latch bar 10 for latch mechanism 73, in the manner discussed previously. The ends of the long straight sides 80 of U-shaped member 79 are bent outwardly, and loosely engage oversize corresponding holes in table leg members 77, all as shown. U-shaped member 79 is formed such that when its ends are removed from the holes in table leg members 77, and relaxed, the space between its outward turning ends is greater than the space between table leg members 77. Thus, when reinserted in the holes in the table leg members, the resilience of U-shaped member 79 urges the ends outwardly, thus maintaining them in position in the holes.

Another elongate pivoting member 90 is pivotally attached, by means of brackets 91 and 92, to the table top near the other end of the table. Member 90 does not have the offset portion as does member 74. Another pair of table leg members 93 have one end of each attached to an intermediate portion of member 90, and the other end attached to another elongate member 94, which in turn has its ends formed outwardly to form pair of legs 70.

A second U-shaped member 95 serves as latch bar, 10 as before, which engages latch mechanism 96, which in turn is attached to the underside of table top 71, all as shown.

The various members of the folding table leg mechanism are so fashioned and so positioned that the straight sides of the U-shaped members slope downwardly at an angle of approximately 40 degrees with respect to the table top when in the latched position.

One of the features of the invention becomes apparent when performing the operation of latching the table legs in an upright position. Latching is preferably effected by positioning the table so that its top surface lies flat on the floor or at least so that it is tilted downwards. Then by simply grasping the legs, such as 70, and pulling upwards and outwards the loop portion of U-shaped latch bar 95 slides along the table top until it encounters latch mechanism 96 at which point it rides upwards on the ramp formed by edges 25 and 26 (see FIG. 1), bears against latch-bar-securing member 12 thus compressing spring 13, and finally drops into place in notches 17 and 18. At this point, spring 13 urges latch-bar-securing member 12 forwardly with its inclined plane portion 46 sliding over the latch bar, thus firmly latching it in place. This operation is augmented by the force of gravity acting on the loop portion of U-shaped latch bar 95 and by the looseness of fit of the ends of the latch bar in the holes in table leg members 93, as described previously. This feature presents a significant advantage not enjoyed by other folding table leg mechanisms.

Conversely, when unlatching the legs it is only necessary to release the latch by pushing against protuberance 47, thus retracting latch-bar-securing member 12 from over the latch bar, and then urging the table legs towards their folded position. Due to the slope of edges 21 and 22, the latch bar will ride up and out of notches 17 and 18 and the legs will then easily fold into position. This represents still another significant feature of the mechanism not provided by other folding table leg mechanisms.

Whereas this invention is here illustrated and described with specific reference to an embodiment thereof presently contemplated as the best mode of carrying out such invention in actual practice, it is to be understood that various changes may be made in adapting the invention to different embodiments without departing from the broader inventive concepts disclosed herein and comprehended by the claims that follow.

I claim:

1. A latch mechanism, comprising a latch-bar-receiving member having one or more notches for receiving a latch bar; a latch-bar-securing member having a wedge formation adapted to slidingly engage the latch bar and continually press it into said notch or notches with forward movement of said wedge formation unlimited by other structure, so as to firmly secure said latch bar in said notch or notches of said latch-bar-receiving member when in a latched position; a spring which urges said latch-bar-securing member into said latched position; and means for an operator to unlatch said latch mechanism by manually opposing said spring and urging said latch-bar-securing member away from said latched position, thus releasing said latch bar from securement in said notch or notches of the latch-bar-receiving member.

2. A latch mechanism according to claim 1, wherein is included compensating means which firmly secures the latch bar in the notch or notches of said latch-bar-receiving member when in latched position, thus substantially preventing relative motion between said latch bar and said latch-bar-receiving member, said compensating means being provided by the notch or notches converging downwardly so the latch bar will be wedged against the sides of the notch or notches above the bottom or bottoms thereof.

3. A latch mechanism according to claim 1, wherein the latch-bar-receiving member is fashioned in the form of a notched elongate housing adapted to receive the latch bar and also to contain the latch-bar-securing member; the latch-bar-securing member has an inclined platform portion which provides the wedge formation for securing the latch bar in the notch or notches when in the latched position, said housing containing the spring in position whereby one end of said spring bears against a portion of said latch-bar-securing member, and the other end of said spring bears against a portion of said housing, thus urging said latch-bar-securing member into the latched position.

4. A latch mechanism according to claim 3, wherein the portion of the latch-bar-securing member against which one end of the spring bears is internally positioned within said latch-bar-securing member, and is spaced apart from an end wall of said latch-bar-securing member through which the other end portion of the spring extends to bear against a protion of the housing.

5. A latch mechanism according to claim 4, wherein a bore is fashioned in an end wall of the latch-bar-securing member for receiving the spring which is adapted to pass therethrough.

6. A latch mechanism according to claim 3, wherein the latch-bar-securing member incorporates means for manual movement of said latch-bar-securing member against the force of the spring.

7. A latch mechanism according to claim 6, wherein the means for manual movement of the latch-bar-securing member comprises an integral protuberance of said latch-bar-securing member which protrudes through a wall of the latch-bar-receiving member.

8. A latch mechanism according to claim 7, wherein the housing has means for attachment to a mounting surface.

9. A latch mechanism according to claim 8, wherein the attachment means comprise flanges at one face of the housing for attachment of said housing to a mounting surface, the face of the housing which has the flanges being open, thus allowing passageway for insertion of the latch-bar-securing member; and wherein said housing is so fashioned that the latch-bar-securing member is closely but loosely contained therein when said housing is attched to a mounting surface.

10. A latch mechanism, comprising a latch bar; a latch-bar-receiving member having side-by-side aligned notches for receiving said latch bar; a latch-bar-securing member having a wedge formation which secures said latch bar in said notches of said latch-bar-receiving member when in a latched position; a spring which urges said latch-bar-securing member into said latched position; wedge shaped compensating means associated with the notches in the latch-bar-receiving member for firmly securing the latch bar in the notches of said latch-bar-receiving member when in latched position, thus substantially preventing relative motion between said latch bar and said latch-bar-receiving member; and means for an operator to unlatch said latch mechanism by manually opposing said spring and urging said latch-bar-securing member away from said latched position, thus releasing said latch bar from securement in said notches of the latch-bar-receiving member; the said latch-bar-receiving member being fashioned in the form of an elongate, notched housing attachable to a mounting surface and adapted to receive the latch bar in said aligned notches and also to contain the latch-bar-securing member; the said spring being a compression spring having one end bearing against a portion of the said latch-bar-securing member, positioned internally thereof, and spaced apart from an end wall thereof which is provided with a bore through which said spring extends to bear against a portion of the said housing; the latch-bar-securing member having a protuberance protruding through a wall of said housing for manual movement of said latch-bar-securing member; said housing having mounting flanges at an open face thereof, which open face provides passage for inserting said latch-bar-securing member into said housing, said housing being so fashioned that said latch-bar-securing member is contained closely but loosely therein when said housing is attached to a mounting surface; the forward end of the elongate housing being open; the aligned notches being positioned in opposing sides of said housing near the open end; and the forward edges of said opposing sides sloping rearwardly and upwardly from the bottom of said sides so as to intersect said notches, thus providing an inclined ramp for said latch bar to slide upon during latching to the position where said latch bar can drop into said notches and thus become latched in place.

11. A latch mechanism according to claim 10, wherein the forward end of the latch-bar-securing member moves forwardly past at least one edge of the notches, when urged forward by the spring, to a position such that said latch-bar-securing member must be at least partially retracted to allow latching of the latch bar, and wherein the allowable rearward movement of said latch-bar-securing member is sufficient to allow said latch bar to engage said notches.

12. A latch mechanism according to claim 11, wherein each notch is fashioned such that its rearward edge is substantially vertical and its forward edge slopes forwardly and upwardly at an angle of at least 5 degrees with respect to the vertical.

13. A latch mechanism according to claim 11, wherein the rearward edge of each notch converges towards the forward edge and is dimensionally fashioned, in cooperation with the latch bar, such that the latch bar fits tightly between said edges prior to descending to the bottom of said notch.

14. A latch mechanism according to claim 13, wherein the latch bar is a resilient substantially U-shaped member with the loop portion of the U adapted to engage the notches.

15. A latch mechanism according to claim 14, wherein each straight side of the U-shaped member has its open end bent outwardly at an angle of substantially 90 degrees with respect to the straight portion.

16. A latch mechanism according to claim 15, adapted to latch the folding legs of a table in an upright position, and adapted to permit unlatching and folding of said folding legs so as to be folded substantially flat with respect to the top of said table, comprising means for attachment of said latch mechanism to the underside of the top of said table; a pair of elongate table leg members having respective transverse oversize opposing holes intermediate the ends thereof adapted to loosely receive the open ends of the U-shaped member; a first elongate pivoting member having means for pivotal transverse attachment to the underside, and near an end, of said table top, and having means for spaced apart attachment, to an intermediate portion of its length, of corresponding upper ends of said table leg members; and a second elongate member having means for spaced apart transverse attachment, intermediate of its length, of the corresponding lower ends of said pair of table leg members, and which also has its ends curved downwardly so as to provide legs for resting on a floor.

17. A latch mechanism according to claim 16, wherein the first elongate pivoting member and the U-shaped member are cooperatively configured so that, when attached to the underneath side of a table top, the straight sides of said U-shaped member slope downwardly at an angle of approximately 40 degrees with respect to the table top when the latch bar is latched in place.

18. A latch mechanism according to claim 17, wherein the first elongate member is fashioned such that the intermediate portion is offset so as to be spaced apart from the table top, when the legs are in the folded configuration, at a distance sufficient to allow the legs to be folded substantially flat over folded legs attached to the opposite end of the table.

19. A folding table, comprising a table top; a pair of dual table legs, which legs are interconnected by a latch bar; a latching mechanism for each pair of legs to hold the corresponding pair of legs in an upright, table-top-supporting position; each of the latching mechanisms comprising a latch-bar-receiving member having one or more notches for receiving, when it is in latching position, a corresponding latch bar; a latch-bar-securing member having a wedge formation adapted to slidingly engage the latch bar and continually press it into said notch or notches with forward movement of said wedge formation unlimited by other structure, so as to firmly secure said latch bar in said notch or notches of said latch-bar-receiving member when in the latching position; a spring which urges said latch-bar-securing member into said latching position; and means for an operator to unlatch said latch mechanism by manually opposing said spring and urging said latch-bar-securing member away from said latching position, thus releasing said latch bar from securement in said notch or notches of the latch-bar-receiving member.

20. A folding table according to claim 19, wherein the latching bar of each pair of dual table legs is U-shaped and pivotally mounted with opposite ends in the dual legs, respectively.

* * * * *